US005451471A

United States Patent [19]

Over et al.

[11] Patent Number: 5,451,471

[45] Date of Patent: Sep. 19, 1995

[54] REINFORCEMENT FIBER FOR REINFORCING CONCRETE

[76] Inventors: Robert H. J. Over, Mimosastraat 106, 8013 SH Zwolle; Alfred W. Over, van Hakfoortmarke 10, 8016 EP Zwolle, both of Netherlands

[21] Appl. No.: 184,183

[22] Filed: Jan. 21, 1994

[30] Foreign Application Priority Data

Jan. 21, 1993 [NL] Netherlands ..... 9300121

[51] Int. Cl.[6] ..... E04C 5/03

[52] U.S. Cl. ..... 428/574; 428/600; 106/644; 52/659

[58] Field of Search ..... 428/600, 606, 573, 574; 106/640, 644; 52/659

[56] References Cited

U.S. PATENT DOCUMENTS

| | | | |
|---|---|---|---|
| 260,659 | 7/1882 | Carter | 428/574 |
| 3,592,727 | 7/1971 | Weaver et al. | 428/600 |
| 3,953,953 | 5/1976 | Marden | 52/659 |
| 3,979,186 | 9/1976 | Mizuma | 428/573 |
| 4,233,364 | 11/1980 | van Thiel | 52/659 |
| 4,804,585 | 2/1989 | Tani et al. | 428/600 |
| 4,883,713 | 11/1989 | Destree et al. | 106/644 |
| 4,960,649 | 10/1990 | Takata et al. | 428/574 |

FOREIGN PATENT DOCUMENTS

| | | | |
|---|---|---|---|
| 252975 | 6/1926 | United Kingdom | 52/659 |
| 1446855 | 8/1976 | United Kingdom | 52/659 |
| 1384688 | 3/1988 | U.S.S.R. | 428/606 |

*Primary Examiner*—John Zimmerman

[57] ABSTRACT

Reinforcement fiber made of metal for the reinforcement of concrete, consisting of a wire piece, which is deformed near both ends over a certain distance. The wire piece is undeformed between the ends and the deformed part. The two extremities of the reinforcement fiber are not deformed over a distance of 1 to 5 mm. The reinforcement fiber is provided with a profiling consisting of a large number of small notches or grooves. The grooves are provided at an angle to the longitudinal axis of the reinforcement fiber. The length of the reinforcement fiber lies between 10 and 70 mm, and the fibers have a length-thickness ratio of between 40 and 70. The ends of the reinforcement fiber are bevelled at an angle of approximately 45 degrees and are slightly flattened. The transition from the deformed part to the undeformed part is provided with a slight bulge.

6 Claims, 3 Drawing Sheets

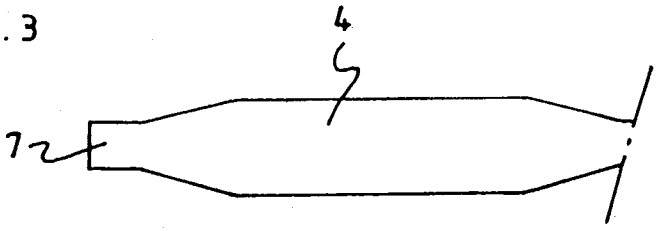
FIG. 3
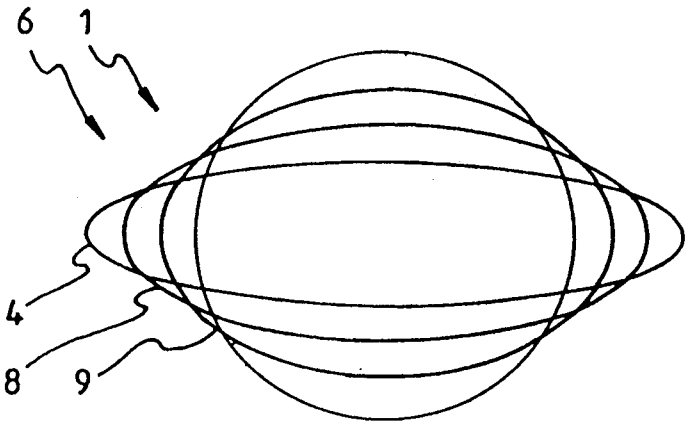
FIG. 4
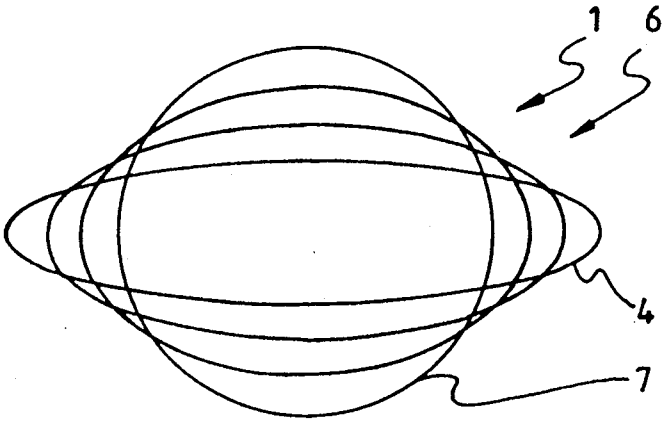

REINFORCEMENT FIBER FOR REINFORCING CONCRETE

FIELD OF THE INVENTION

The invention relates to a reinforcement fiber or wire piece made of metal, preferably of steel, for the reinforcement of concrete. Such wire pieces or reinforcement fibers are commonly used for adding as a reinforcement to mortar or concrete, in order to increase the strength of the concrete. The tensile strength of the set concrete is then increased in all directions.

DESCRIPTION OF THE PRIOR ART

It is preferable to use fibers in which the length-thickness ratio is as great as possible. However, it has been found in practice that it is preferable to use reinforcement fibers whose length lies between 10 and 70 mm and whose fiber diameter lies between 0.4 and 2 mm, and in which the length-thickness ratio lies between 30 and 80.

It is becoming increasingly common to use reinforcement fibres in which parts of the fiber are bent, and the surface of which has been roughened by, for example, deformation. It appears that as a result of this, when the concrete in which the fibers are incorporated begins to break, the forces occurring cause fibers to be stretched in the lengthwise direction, with the result that the thickness of the fibers decreases, and said fibers are easily pulled out of the concrete.

SUMMARY OF THE INVENTION

The object of the invention is a reinforcement fiber which is prevented from being pulled out of the concrete when a force is exerted in the lengthwise direction, due to the thickness of the fiber decreasing.

This object of the invention is achieved by a reinforcement fiber according to the invention through the fact that the reinforcement fiber consists of a wire piece, which wire piece is deformed near both ends over a certain distance, which distance is smaller than ten times the thickness of the wire piece and greater than three times the thickness, in such a way that the thickness of the deformed part lies between 0.2 and 0.6 and the width lies between 1.5 and 3 times the thickness of the wire piece. It appears that by designing the fiber according to the invention the force required to pull the fiber out of the concrete has become much greater than was the case until now with comparable fibers known hitherto. Due to the fact that the cross-section of the fiber changes very greatly over a short distance, namely at the transition from the round fiber to the flattened part, what is achieved is that the resistance there has become very great if a force is exerted in the lengthwise direction of the fiber. Another advantage of these straight reinforcement fibers is that balling or caking together will not occur, in contrast to, for example, fibers which are provided with bent ends or with hooks.

In a preferred embodiment of the reinforcement fiber according to the invention, it is characterized in that at a distance from both ends, which distance lies between zero and five times the thickness, the deformed part of the wire piece begins, while the wire piece is undeformed between the ends and the deformed part. Due to the fact that at both ends on either side of the deformation of the wire piece the cross-section of the fiber is again greatly changed in shape, namely where the flattened part again passes into the round end, a second resistance to the pulling out of the fiber in the lengthwise direction is produced, with the result that the fiber is even more difficult to pull out of the concrete in the lengthwise direction.

The reinforcement fiber is preferably designed in such a way that the ends of the reinforcement fiber are bevelled at an angle of approximately 45 degrees and slightly flattened. This has the advantage that the reinforcement fiber is less exposed to bending or crushing stress when the enclosing concrete is put under pressure.

The reinforcement fiber can also be produced in such a way that the transition from the deformed part to the undeformed part is provided with a slight bulge. This means that tension concentrations are avoided and the reinforcement fiber is strengthened.

The external surface of the fiber is preferably roughened, for example through notches at right angles to the longitudinal axis of the fiber or slanting at an angle to the longitudinal axis. Another possibility is to make a helical or corkscrew-type groove on the external surface of the fiber.

BRIEF DESCRIPTION OF THE DRAWINGS

The invention will be explained in greater detail with reference to the drawing. In the drawing:

FIG. 3 shows greatly enlarged the flattened end part of the fiber according to the invention;

FIG. 4 shows diagrammatically the type of deformation occuring at the transition from the flattened part to the round shape of the fiber;

DESCRIPTION OF THE PREFERRED EMBODIMENTS

Figure 1:
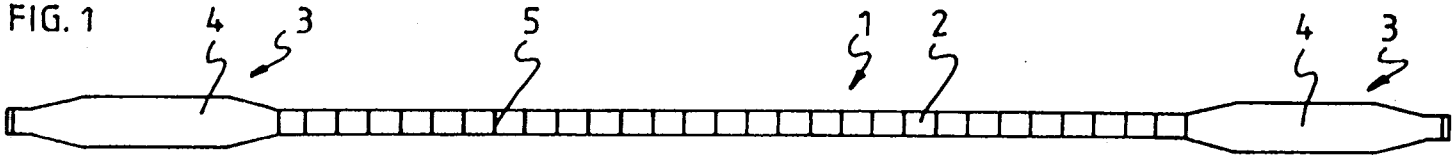
FIG. 1 shows a top view of the fiber according to the invention.
Figure 2:
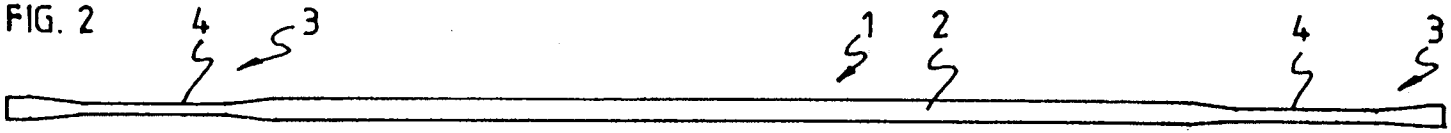
FIG. 2 shows a side view of the fiber according to the invention from FIG. 1.

FIGS. 1 and 2 show two views of the reinforcement fiber 1 according to the invention. The reinforcement fiber 1 consists of a piece of steel wire 2 with a circular cross-section. Near the two ends 3 of the fiber 1 a part 4 is deformed. Through the flattening, for example with a roller, a part of the wire has become broader in one direction and thinner in the other direction. In this embodiment of the reinforcement fiber according to the invention, the surface of the fiber facing upwards and downwards is provided with a number of notches 5.

FIG. 3 shows in greater detail a greatly enlarged flattened part 4, while FIG. 4 shows a number of successive cross-sections of the fiber 1 at the point where the wire is deformed. This deformation occurs both at the one side 6 of the flattened part 4 and at the other side 6 of the flattened part 4, at the point where the flattened part 4 again passes into a small part 7 of steel wire or reinforcement fiber, and goes up to the end of the reinforcement fiber 1.

FIG. 4 shows in the same figure a number of successive cross-sections through the transitions 8 and 9 of the flattened part 4 to the round part of the fiber 1.

Figure 5:
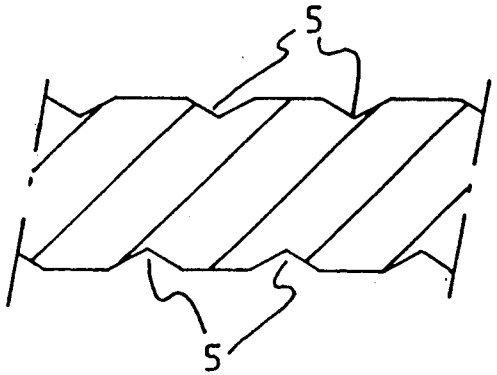
FIG. 5 shows a detail of the fiber with notches.

FIG. 5 shows in longitudinal section a part of the fiber at the point where it is provided with notches 5, which are provided in principle on two surfaces lying opposite each other, in such a way that all notches on the top side are staggered alternately in relation to the notches on the bottom side. The embodiment in which the notches are provided at an angle to the longitudinal axis of the fiber is not shown.

Figure 6:
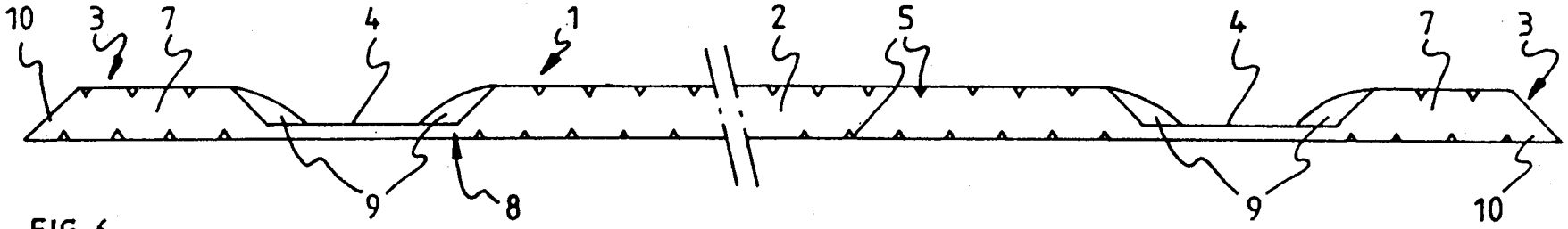
FIG. 6 shows a side view of an alternative embodiment according to the invention.

FIG. 6 shows another embodiment according to the invention. The reinforcement fiber 1 is flattened near the ends 3 over a part 4. The bottom side 8 in this case has remained flat. The transition between the flattened parts 4 and the undeformed parts of the reinforcement fiber 1 is provided with a bulge or rib 9. The shape transition is consequently less sharp at that point. This means that tension concentrations are avoided and the reinforcement fiber 1 is strengthened. The reinforcement fiber 1 is also provided with slightly widened and bevelled ends 10. This produces new shape transitions at those points, which make the reinforcement fiber 1 anchor even better in the concrete. The bevelled ends 10 prevent the reinforcement fiber 1 from being subjected to bending or crushing stress when the surrounding concrete is subjected to pressure.

Figure 7:
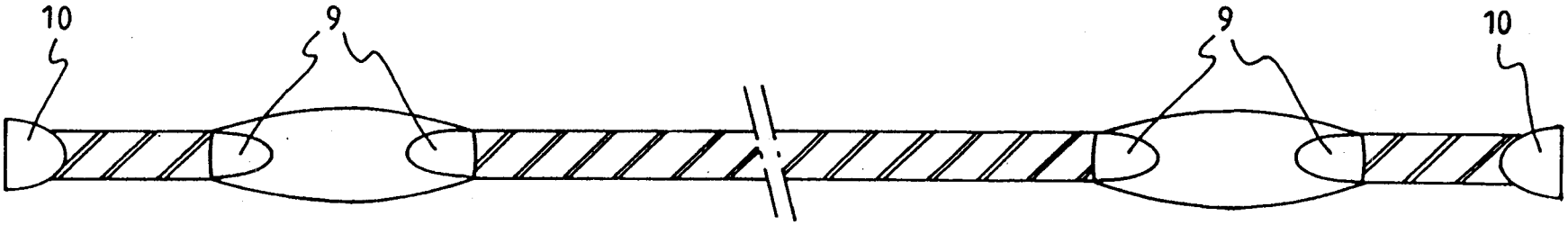
FIG. 7 shows a top view of the embodiment according to FIG. 6.

FIG. 7 shows the same reinforcement fiber as that of FIG. 6, but in top view.

It appears that this method of anchoring the reinforcement fibers in concrete ensures that they remain very well anchored, and the full fiber length can be used to absorb forces. Moreover, these fibers are straight and therefore very easily mixed through the mortar, and it has been found that no balling of the fibers occurs.

Of course, the invention is not limited to the embodiments discussed here. It is also possible to deform several parts of the fiber so that the fiber is alternately round and flattened, for example, over distances varying from 0.5 to 5 mm, and the flattened parts are also sometimes alternately rotated a quarter turn relative to each other. Such straight fibers with alternately flat and round parts of, for example, 3 mm are, of course, even more resistant to pulling out in the lengthwise direction, but more working operations have to be performed in order to produce such fibers.

We claim:

1. Reinforcement fiber or wire piece made of metal, comprising steel, for the reinforcement of concrete, characterized in that the reinforcement fiber consists of a wire piece, which wire piece is deformed near both ends over a distance, said distance being smaller than ten times the thickness of the wire piece and greater than three times the thickness of the wire piece and greater than three times the thickness, such that the thickness of the deformed part lies between 0.2 and 0.6 and the width lies between 1.5 and 3 times the thickness of the wire piece, at a distance from both ends, which distance lies between zero and five times the thickness, the deformed part of the wire piece begins, while the wire piece is undeformed between the ends and the deformed part, the ends of the reinforcement fiber are bevelled at an angle of approximately 45 degrees and are slightly flattened.

2. Reinforcement fiber according to claim 1 wherein the transition from the deformed part to the undeformed part is provided with a slight bulge.

3. Reinforcement fiber according to claim 1 wherein the reinforcement fiber is provided with a profiling consisting of a large number of small notches or grooves.

4. Reinforcement fiber according to claim 3, wherein the grooves are provided at an angle to the longitudinal axis of the reinforcement fiber.

5. Reinforcement fiber according to claim 3, wherein the profiling comprises a corkscrew-type groove around the external surface of the reinforcement fiber.

6. Reinforcement fiber according to claim 1 wherein the length of the reinforcement fiber lies between 10 and 70 mm, and the fibers have a length-thickness ratio of between 40 and 70.

* * * * *